US008011123B2

(12) United States Patent
Ferris

(10) Patent No.: US 8,011,123 B2
(45) Date of Patent: Sep. 6, 2011

(54) TAP HANDLE THAT DISPLAYS A KEG CAP

(75) Inventor: Matthew Marsh Ferris, Louisville, CO (US)

(73) Assignee: Matthew M. Ferris, Louisville, CO (US)

( * ) Notice: Subject to any disclaimer, the term of this patent is extended or adjusted under 35 U.S.C. 154(b) by 22 days.

(21) Appl. No.: 12/564,000

(22) Filed: Sep. 21, 2009

(65) Prior Publication Data

US 2011/0067276 A1 Mar. 24, 2011

(51) Int. Cl.
*G09F 3/00* (2006.01)

(52) U.S. Cl. ..... 40/332

(58) Field of Classification Search ..... 40/331, 40/332, 306; 220/366.1, 367; 222/23, 192, 222/566

See application file for complete search history.

(56) References Cited

U.S. PATENT DOCUMENTS

| | | | | | |
|---|---|---|---|---|---|
| 1,197,380 | A * | 9/1916 | Maass, Jr. et al. | ..... | 40/332 |
| 1,642,264 | A * | 9/1927 | Pilkington | ..... | 40/332 |
| 2,573,042 | A * | 10/1951 | Minovitz | ..... | 40/332 |
| 3,430,377 | A * | 3/1969 | Ellison | ..... | 40/332 |
| 4,705,188 | A * | 11/1987 | Rahn | ..... | 220/366.1 |
| 5,499,427 | A * | 3/1996 | Bowman | ..... | 16/417 |
| 7,246,727 | B2 * | 7/2007 | Magermans et al. | ..... | 222/529 |

OTHER PUBLICATIONS

Partingon, Eric R.; Beer Barrels: from Roman times to the Present Day; Encyclopaedia of Food Science and Nutrition, 2003; pp. 383-393.*

* cited by examiner

*Primary Examiner* — Joanne Silbermann
*Assistant Examiner* — Christopher E Veraa

(57) ABSTRACT

A handle for a beverage dispensing tap that incorporates a feature that permits a protective cap from the Barnes neck of a malt beverage keg to be attached for the purpose of identifying the beverage being dispensed.

5 Claims, 4 Drawing Sheets

TAP HANDLE THAT DISPLAYS A KEG CAP

FIELD OF INVENTION

The present invention relates to handles for beverage dispensing taps. More specifically, it relates to handles dispensing from kegs of malt beverages, such as beer.

BACKGROUND

Malt beverages, such as beer, are sold in containers that are either considered disposable, such as bottles and cans, or reusable, such as kegs.

Kegs generally have limited labeling and identification on them. This is due primarily to the fact that when in use the keg is located remotely from the dispensing location, where the keg cannot be seen. Common forms of keg identification include labels that are attached to the container or a removable keg cap. The keg cap, of the type shown in Rahn U.S. Pat. No. 4,705,188, and associated labeling is the most universal and common means of identifying the beverage contained within the keg.

Because dispensing taps for kegs are located remotely from the refrigerated area where the keg is stored, any labeling or identification on the keg itself is no longer useful in specifying what beverage the tap will dispense. Most brewers produce and sell custom tap handles that correspond to their particular brand or product(s) that can be attached to dispensing taps to identify the beverage being dispensed. However, such custom tap handles are expensive and somewhat difficult for non-commercial entities to obtain. Furthermore, a new custom tap handle is required for each new beverage that is dispensed.

There is a need for a tap handle that can be easily and inexpensively customized to identify a wide variety of specific kegged beverages.

SUMMARY OF THE INVENTION

The object of the present invention is to disclose a simple tap handle that can display a keg cap, thus relocating part of the keg labeling to the tap handle to identify the beverage the tap will dispense.

DETAILED DESCRIPTION OF THE INVENTION

In FIGS. 1 to 4 of the drawings, it can be seen that the handle consists of a head 10 and a stem 11.

Figure 1:
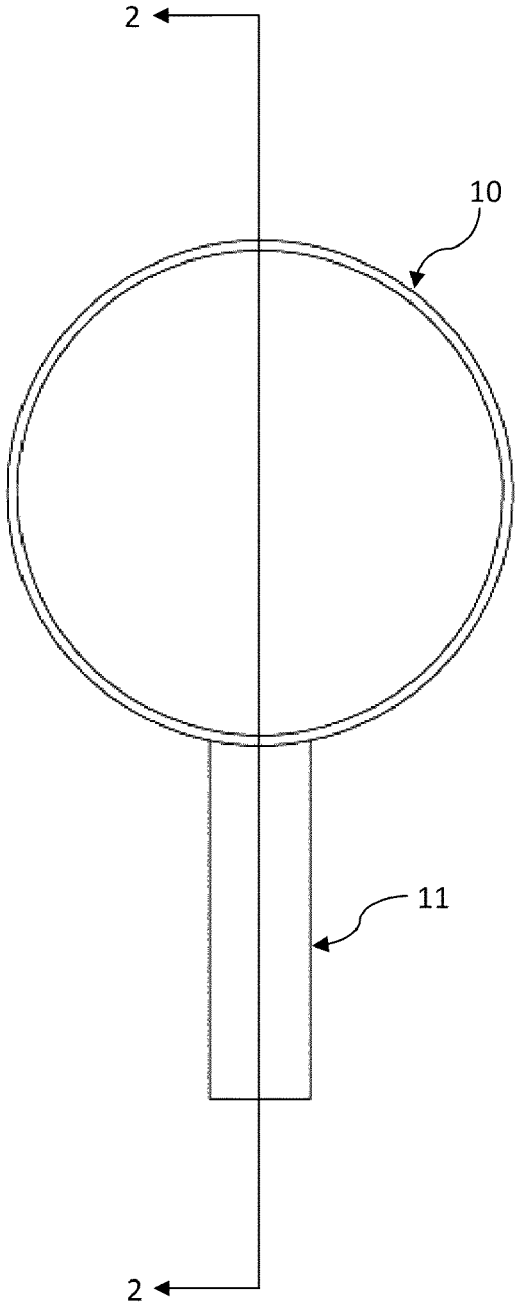
FIG. 1 is a front view of the handle of the present invention.
Figure 2:
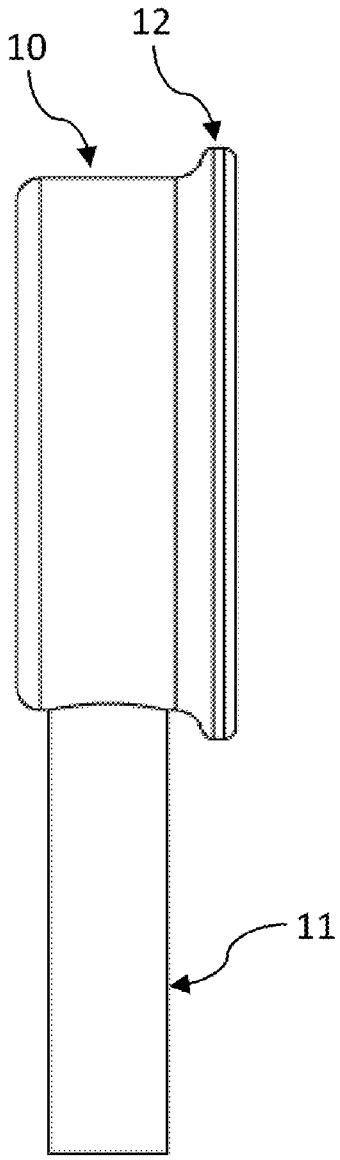
FIG. 2 is a side view of the handle of FIG. 1.

As best seen in FIG. 2, the handle head 10 has a feature 12 similar to the Barnes neck of a keg.

Figure 3:
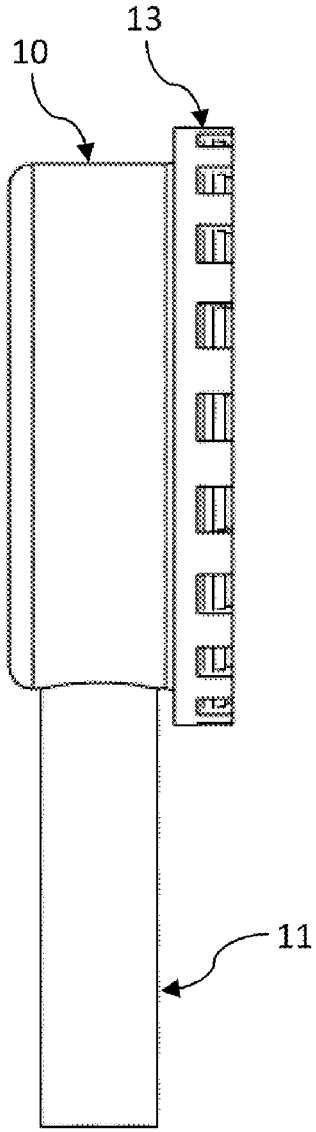
FIG. 3 is a side view of the handle in FIG. 2 with a keg cap in place.
Figure 4:
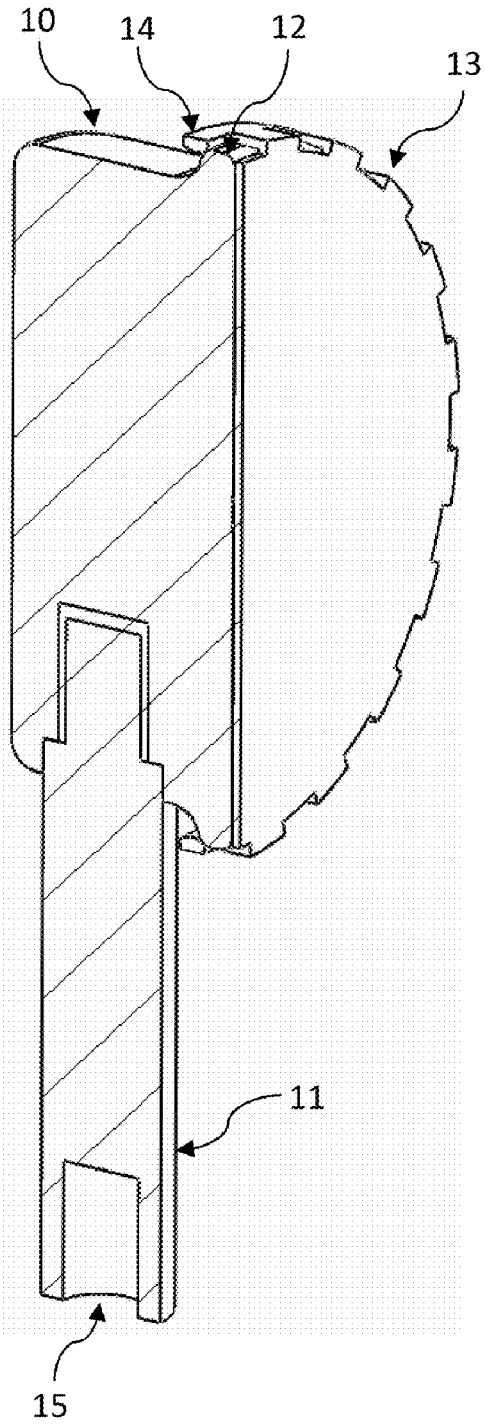
FIG. 4 is a view, partly in section, along line 2-2 of FIG. 1, of the handle in FIG. 3.

In FIGS. 3 to 4 of the drawings, it can be seen that a keg cap 13, of the type shown in Rahn U.S. Pat. No. 4,705,188, attaches to the handle. The annular bead 14 of the keg cap 13 grips feature 12 of head 10 to secure keg cap 13 to the handle. Feature 12 is sized so that the grip of annular bead 14 of keg cap 13 keeps keg cap 13 secure on head 10 of the handle.

As best seen in FIG. 4 of the drawings, stem 11 of handle has a threaded receiver 15 that allows the handle to be attached to a dispensing tap.

The preferred head 10 and stem 11 of the handle are formed from a suitable metal material, such as aluminum, which is sufficiently strong to resist flex and wear.

It will be readily apparent to those skilled in the art that a number of other changes and modifications may be made without departing from the spirit and scope of the present invention. For example, the handle could be formed as a single piece from thermoplastic material. Therefore, it is intended that the invention not be limited except by the claims.

I claim:

1. A handle for a beverage dispensing tap, which comprises a rim being of a size and shape similar to the Barnes neck of a keg, wherein the rim allows the annular ring of a keg cap to grip the rim of said handle to secure said keg cap to said handle.

2. The handle of claim 1, further comprising a keg cap attached to said rim.

3. The handle of claim 1, wherein said keg cap provides information to identify the beverage being dispensed by said handle.

4. The handle of claim 1, wherein said handle comprises aluminum.

5. The handle of claim 1, wherein said handle comprises thermoplastic material.

* * * * *